US006527155B2

(12) United States Patent
Buckley et al.

(10) Patent No.: US 6,527,155 B2
(45) Date of Patent: Mar. 4, 2003

(54) TABLET SPLITTING APPARATUS

(75) Inventors: Thomas L. Buckley, Laguna Niguel, CA (US); John I. Muri, Aliso Viejo, CA (US)

(73) Assignee: Links Medical Products, INC, Irvine, CA (US)

( * ) Notice: Subject to any disclaimer, the term of this patent is extended or adjusted under 35 U.S.C. 154(b) by 0 days.

(21) Appl. No.: 09/867,380

(22) Filed: May 30, 2001

(65) Prior Publication Data

US 2002/0179666 A1 Dec. 5, 2002

(51) Int. Cl.[7] ..... B26F 3/00

(52) U.S. Cl. ..... 225/1; 83/607

(58) Field of Search ..... 225/1; 83/607

(56) References Cited

U.S. PATENT DOCUMENTS 5,038,475 A * 8/1991 Wolff ..... 225/124

* cited by examiner

*Primary Examiner*—Douglas D. Watts
(74) *Attorney, Agent, or Firm*—Jerry R. Potts

(57) ABSTRACT

A manually operable tablet splitting apparatus, including a base having a frame mounted on an upper surface thereof and a disposable tablet-receiving tray, including a plurality of tablet shaped cavities for receiving and holding the tablets in position to be split. A handle is pivotally attached to the base and is movable between a tablet loading position and a tablet splitting position. The handle includes a blade for splitting the tablets into two substantially equal parts. A retractable shield is provided for covering the blade while it is in the tablet loading position, thereby reducing the likelihood of injury to an operator during operation of the apparatus. Each one of the tray cavities is adapted for receiving a tablet and for holding the received tablet in position for splitting.

21 Claims, 4 Drawing Sheets

TABLET SPLITTING APPARATUS

BACKGROUND OF THE INVENTION

The present invention relates generally to patient care devices and, more particularly, to tablet splitting apparatus.

Modern medicines come in a variety of forms and commonly the form is that of a tablet. This can be defined generally as a small, usually soluble medicated mass that is shaped to facilitate swallowing. Typically, a tablet contains filler and an excipient substance that facilitates working it into a form suitable for swallowing by a patient.

It is well known that tablets, such as anti-depressants, antibiotics and the like, are available wherein the active ingredient is present in a particular dose, as for example, 10, 30 or 50 milligrams per tablet. In general, the manufacturing costs are not substantially impacted by the size of the dose and the costs of production for a 10 milligram (mg) tablet, for example, are about the same as those for a 50 mg tablet. Thus, pharmaceutical companies sometimes produce tablets having a dosage that is driven, at least in part, by financial considerations.

As a result, in some cases available tablet dosages differ from those prescribed by the patient's physician and the available tablet has a dosage exceeding the patient's needs. For example, in cases where a prescription calls for a 10 mg tablet, and only a 20 mg tablet is available, it becomes necessary to split the tablet so that the patient receives the appropriate dosage.

Typically, tablets come in a variety of sizes and shapes, and, because of the manufacturing process, often have a hard outer shell. The presence of the shell can make tablet splitting a difficult, inexact and time consuming process. As a practical matter, the patient has no effective technique for dividing the tablet into two equal parts.

The dispensing pharmacy may have a conventional device for splitting a tablet but any such known device works on a single tablet at a time and their use can result in division of a tablet into unequal portions. Further, the single splitting process is time consuming and not economically feasible for the pharmacy to perform.

In view of the foregoing, it would be desirable to have an apparatus that would facilitate the tablet splitting process. Desirably, such an apparatus would repetitively produce substantially equally divided tablets in an economically feasible manner.

DISCLOSURE OF THE INVENTION

According to the present invention, there is provided a manually operable tablet splitting apparatus, including a base having a frame mounted on an upper surface thereof and a disposable tablet-receiving tray, including a plurality of tablet shaped cavities for receiving and holding the tablets in position to be split. A handle is pivotally attached to the base and is movable between a tablet loading position and a tablet splitting position. The handle includes a blade for splitting the tablets into two substantially equal parts. A retractable shield is provided for covering the blade while it is in the tablet loading position, thereby reducing the likelihood of injury to an operator during operation of the apparatus. Each one of the tray cavities is adapted for receiving a tablet and for holding the received tablet in position for splitting. The tray is composed of plastic material and is disposable. A finger grip tab on the tray facilitates the installation of the tray into, and removal of the tray from the frame. A chute for loading tablets in the tray is provided. The present invention includes methods of using the tablet splitting apparatus.

The present invention affords several advantages. For example, the apparatus is efficient in use, providing a reliable technique for splitting a plurality of tablets accurately, in a single operation. Since each tablet is nested in its own shaped cavity, it is aligned for accurate splitting. In addition, the use of the disposable tray results in confinement of tablet particles within the tray cavities, thereby reducing the likelihood of contamination of the apparatus.

In summary, the tablet splitting apparatus embodying the invention, in addition to affording substantial cost savings, is inexpensive to manufacture and reliable and dependable in performance.

Other aspects and advantages of the present invention will become apparent from the following detailed description, taken in conjunction with the accompanying drawings, illustrating by way of example the principles of the invention.

SUMMARY OF THE INVENTION

Figure 1:
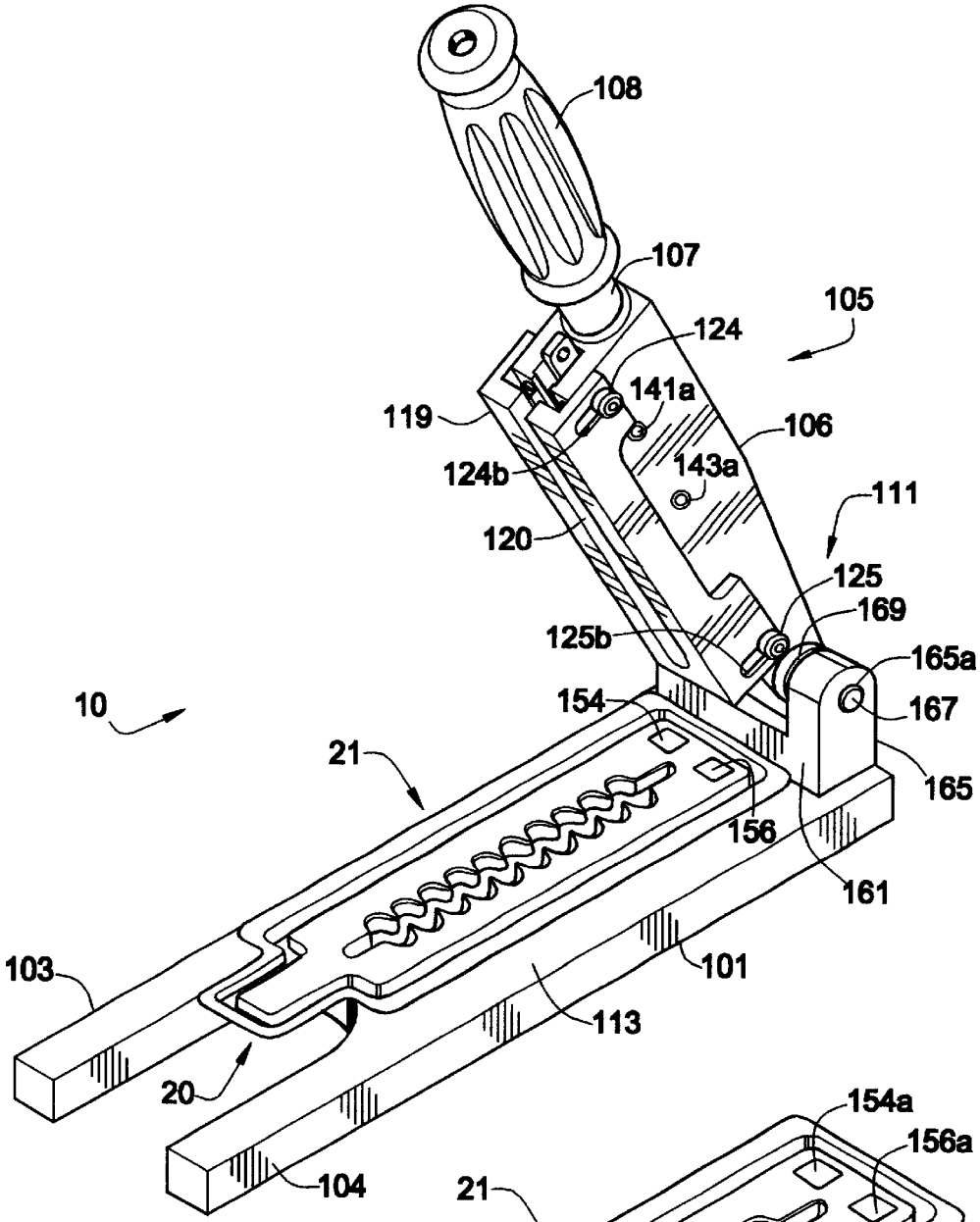
FIG. 1 is a perspective view of a tablet splitting apparatus that is constructed according to the present invention.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes that come within the meaning and range of equivalency of the claims are to be embraced within their scope.

Before considering the drawings in detail, a summary of the construction and function of the present invention will be helpful. The invention is designed for splitting, into substantially equal parts, solid medication tablets of various sizes and shapes. The common shapes of tablets are: round flat, round lentil, capsule, oval flat, oval round, and modified heart. The present invention has the capacity to split a plurality (typically 8 to 10) tablets at one time. In each case, the tablets are positioned within the tablet splitting apparatus so that each tablet is split into substantially equal parts in a very short time, with very little effort.

In general, the tablet splitting apparatus comprises: 1) a manually operated guillotine or blade, a disposable plastic receiving tray for holding and positioning the tablets during splitting; and 3) a tablet loading chute for precise loading of the tablets into the plastic tray. It will be noted that, among the several advantages afforded by the present invention, the use of the disposable tray aids in preventing contamination of the apparatus when tablets having different medications are split.

The tablet splitting apparatus includes a splitting blade placed in a handle that is pivotally attached to a base. Extension springs move the handle to an up position for tablet loading while a downward manual force exerted by an operator accomplishes tablet splitting. A spring loaded protective shield covers the blade. This shield is retracted and the blade is exposed for tablet splitting when the shield is pressed against the base.

The base includes a frame shaped to receive the disposable tablet holding tray. The frame holds the tray in the median of the base directly beneath the splitting blade. This novel aspect of the present invention enables an operator to split a plurality of tablets, in a single operation, into substantially equal parts and to retain the split parts, and any small tablet particles, within the tray cavities. The disposable tray, in one embodiment of the present invention, includes a finger engageable tab for enabling easy insertion of the tray into the apparatus and easy removal therefrom.

BEST MODE FOR CARRYING OUT THE INVENTION

As shown more particularly in the drawings, the present invention is a tablet splitting apparatus, comprising a base having a frame mounted on an upper surface thereof and a tray for receiving and holding the tablets in position to be split. A movable handle is pivotally attached to the base, the handle including a blade for splitting the tablets.

In a presently preferred embodiment of the invention, the tray includes a plurality of tablet-shaped cavities wherein each cavity is adapted for receiving a tablet and for holding the received tablet in position for splitting. The tray is composed of plastic material and is disposable. A finger grip tab on the tray facilitates installation and removal of the tray with respect to the frame. The present invention includes a chute for loading tablets in the tray.

As mentioned, the handle is movable. It is pivotally attached to the base, thereby enabling movement of the handle between a tablet loading position and a tablet splitting position. A retractable shield is provided for covering the blade while it is in the tablet loading position, thereby reducing the likelihood of injury to an operator as the tray is installed.

The present invention includes methods of using the tablet splitting apparatus.

In the following detailed description and in the several figures of the drawings, like elements are identified with like reference numerals.

Referring now to the drawings, and particularly FIGS. 1–5, there is shown a novel tablet splitting apparatus 10 that is constructed according to the present invention. The tablet splitting apparatus 10 includes an elongated base 101, and a handle assembly 105 that holds a replaceable blade 115. The handle assembly 105 is pivotally attached to the base 101 at a hinge assembly 111. The handle assembly 105 is movable about the hinge assembly 111, between a tablet loading position and a tablet splitting position. The base 101 is flat and rectangular, having an upper surface 113 for positioning thereon of a frame 114. The frame 114 is configured to receive a disposable tablet-receiving tray 21 that positions a plurality of tablets for the tablet splitting operation. While the frame 114 is shown as separable from the base, it will be recognized that the frame 114 could be integrally formed as a part of the base 101.

As mentioned, the base 101 is elongated, having a pair of parallel legs 103 and 104 extending from an end thereof. The hinge assembly 111 is located at an end of the base 101 opposite the legs 103 and 104. The assembly 111 includes a boss 161 having a pair of upwardly extending posts 163 and 165 each having dowel pin receiving openings 163*a* and 165*a*, respectively, formed therein.

Figure 5:
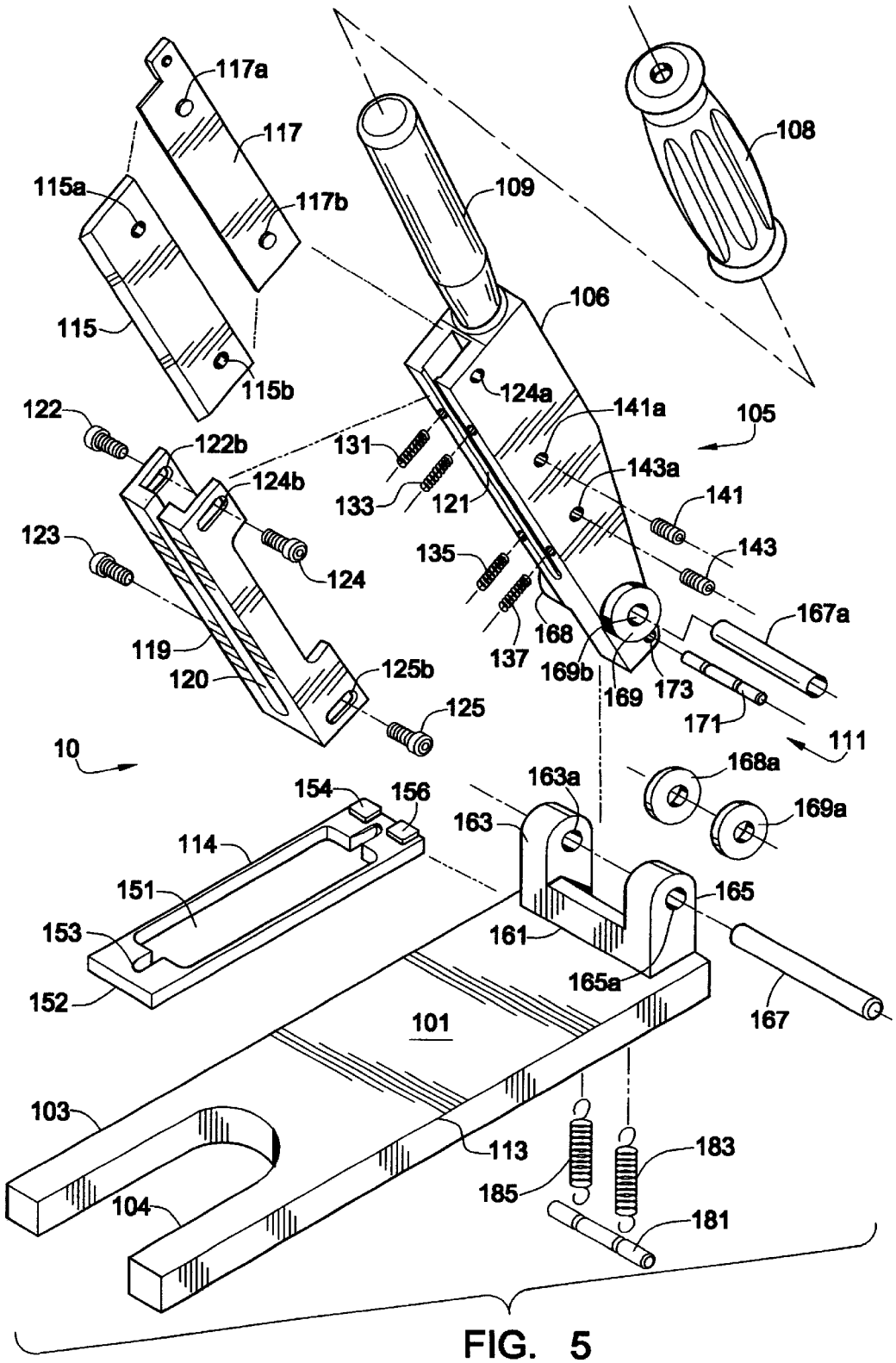
FIG. 5 is an exploded view of the apparatus of FIG. 1.

The handle assembly 105 comprises an elongated handle body 106 having a tubular extension 107 that is partially covered by a grip 108. A pair of bosses 168 and 169 is formed on the sides of the assembly 105, opposite the grip 108. As best shown in FIG. 5, an opening 169*b* is formed in the boss 169. The handle assembly 105 and the base 101 are readily joined at the hinge assembly 111 when a dowel pin 167 is inserted through an opening 165*a* in the post 165, thence through a handle assembly opening 167*b* and the opening 163*a*, formed in the post 163.

In a presently preferred embodiment of the invention, the handle body 106 and the base 21 are composed of aluminum. Thus, bronze washers 168*a* and 169*a* are interposed between the handle body 106 and the posts 163 and 165, respectively, in order to ensure smooth, non-wearing of aluminum surfaces. For a similar reason, a bronze sleeve 167*a* covers the dowel pin 167.

Figure 4:
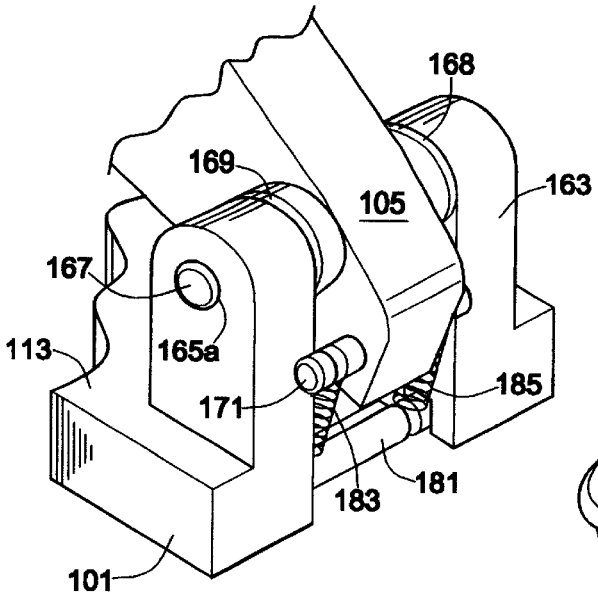
FIG. 4 is a fragmentary view of the tablet splitting apparatus of FIG. 1, showing the relationship between the handle and the base of said apparatus.
Figure 3:
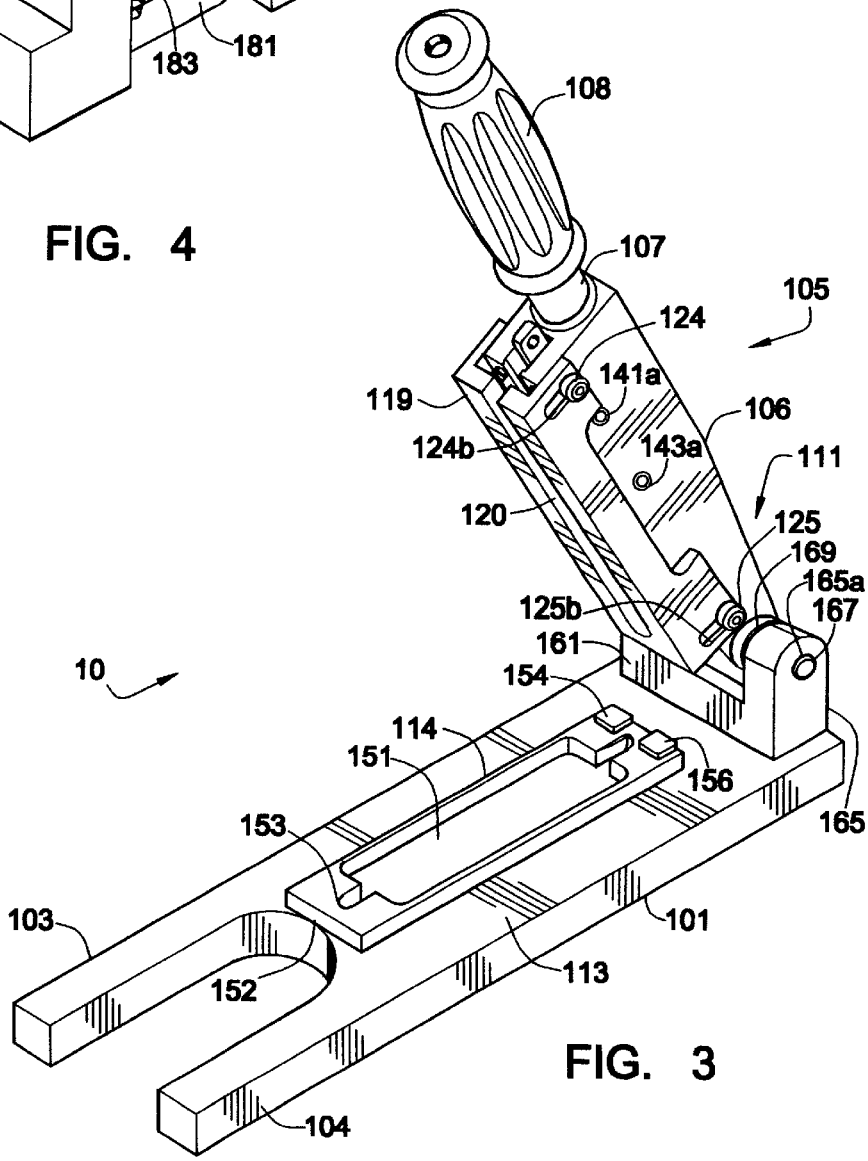
FIG. 3 is another perspective view of the apparatus of FIG. 1.

Considering further the relationship between the base 21 and the handle assembly 105, as best shown in FIG. 4, an upper spring retainer 171 and a lower spring retainer 181 are located between the posts 163 and 165. Extension springs 183 and 185, each having an end fixed to the retainers 171 and 181, serve to urge the handle assembly 105 into the tablet opening position.

As stated above, the handle body 106 is part of the handle assembly 105. The handle body 106 is rectangular in configuration, having an elongated U-shaped groove 121 therein formed. A blade shield 119, having a corresponding U-shaped groove 120, is attached to the handle body 106. Attachment is accomplished utilizing shoulder bolts 122, 123, 124 and 125. Each of these bolts is threaded into a respective opening in the handle body 106. Exemplary of such attachment is the opening 124*a* that receives the bolt 124. Elongated slots, such as the slots 122*b*, 124*b* and 125*b* are formed in the shield 119 for passage therethrough, respectively, of the shoulder bolts 122, 124 and 125. Two pairs of springs 131, 133 and 135, 137, are interposed between the handle body 106 and the shield 119. The springs serve to urge the shield into a blade protecting relationship when the handle assembly 105 is in the tablet-loading position.

As best shown in FIG. 5, the blade 115 is located against a blade holder 117 by means of studs 115*a* and 115*b* on the blade 115. The studs are received, respectively, into openings 117*a* and 117*b* formed in the blade holder 117. During assembly of the apparatus 10, the blade holder 117 and the blade 115 are inserted into the handle body 106 through the U-shaped grooves 120 and 121 formed, respectively, in the shield 119 and the handle body 106. Fasteners such as Allen bolts 141 and 143 are threaded into respective openings 141*a* and 143*a* in the handle body 106 for engaging and securing the blade holder 117 (and the blade 115) within the handle body 106.

The frame 114 and its relationship to the base 101 will now be considered in greater detail. The base includes an upper surface 113 on which the frame is medially located for the tablet splitting operation. The frame 114 is flat and rectangular in shape. Typically, it is composed of aluminum and has a generally rectangular opening 151 formed in it for receipt of the disposable tablet-receiving tray 21.

A slot 153 extends from the opening 151 at an end 152 of the frame 114. The slot 153 facilitates easy insertion and removal of the tray 21. Studs 154 and 156 are located on the frame 114 at an end opposite the end 152.

Figure 2:
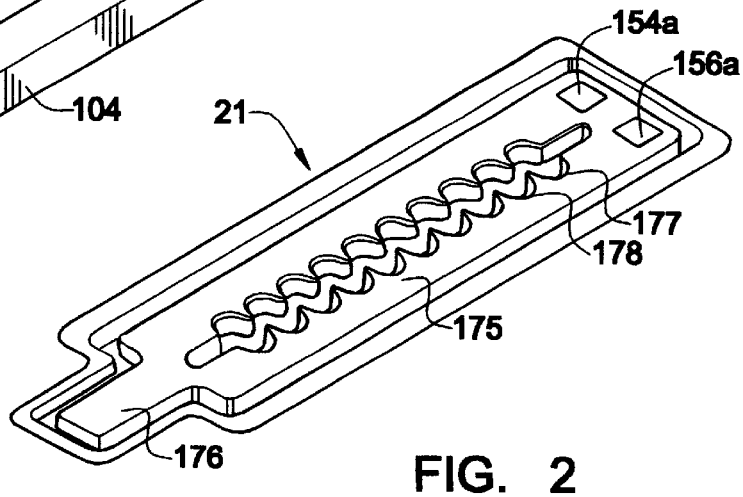
FIG. 2 is a perspective view of a tablet-receiving tray utilizable in the apparatus of FIG. 1.

As best shown in FIG. 2, the tray 21 is generally rectangular in shape, having a body portion 175 and a finger engageable tab 176. The tab 176 rests in the slot 153 when the tray is positioned in the frame 114. Openings 154*a* and 156*a* are formed in the tray body 175. The openings 154*a* and 156*a* respectively, receive the studs 154 and 156 to help center the tray 21 on the frame 114. A plurality of tablet shaped cavities, such as the cavities 177 and 178, are formed in the tray body 175. It will be readily apparent that the cavities may be identical for receipt of similar tablets or a variety of shapes may be formed in the tray body 175 for receipt of a variety of tablets.

Figure 6:
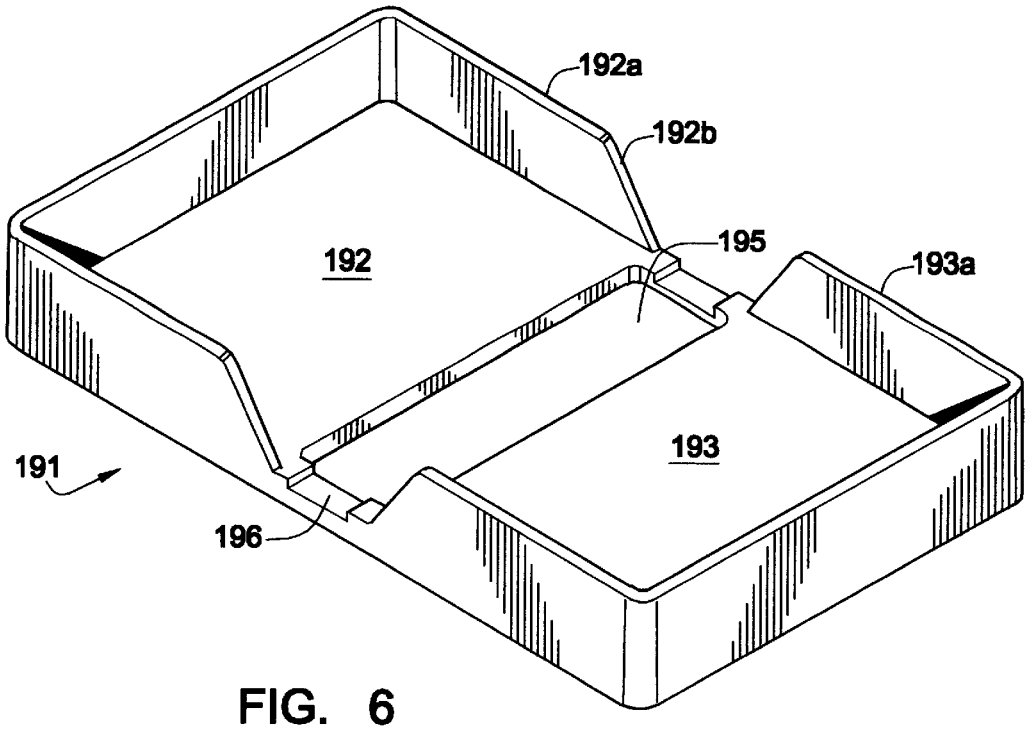
FIG. 6 is a perspective view of a chute utilizable in loading tablets into the tray.
Figure 7:
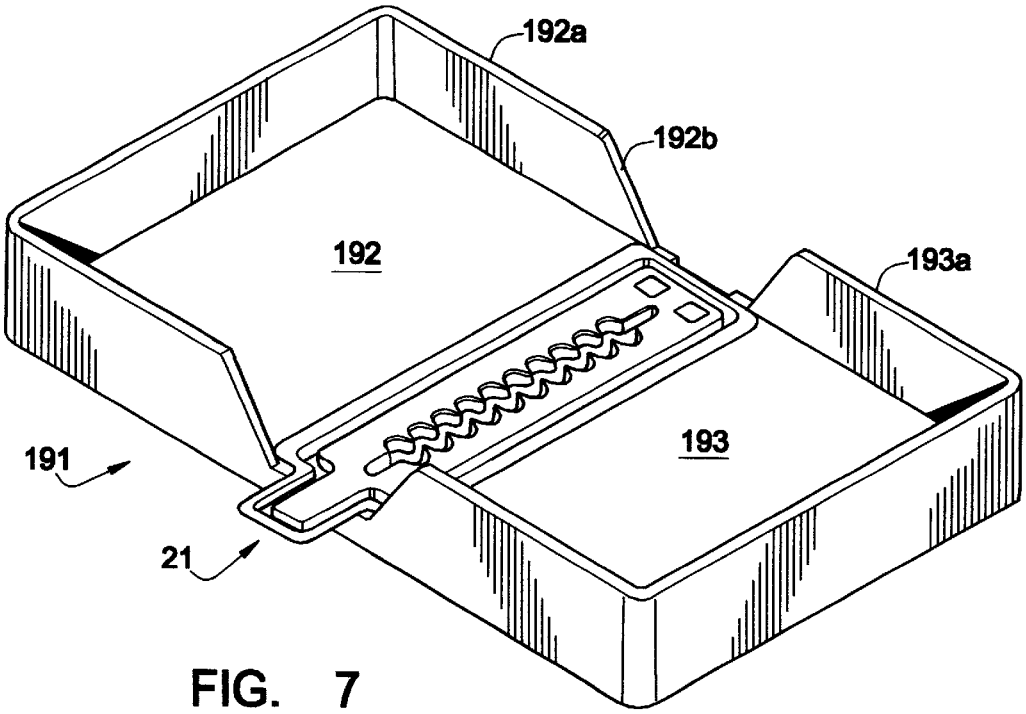
FIG. 7 is a perspective view taken showing the relationship between the tray and the tablet-loading chute of FIG. 6.

The tablet splitting apparatus 10 enables an operator, such as a pharmacist, to split many tablets in a relatively short span of time. A molded plastic tray-loading chute 191, shown in FIGS. 6 and 7, represents a novel time saving feature of the present invention. The chute 191 includes a pair of flat tablet loading areas 192 and 193 having sidewalls 192*a* and 193*a*, respectively. As shown in FIG. 6, portions of the sidewalls 192*a* and 193*a* are sloped, for example at 192*b*, toward a centrally disposed tray receiving opening 195. A recess 196, formed in the chute 191, receives the tab 176.

During operation of the apparatus 10, the tablet-receiving tray 21 is positioned in the chute 191 as shown in FIG. 7 and a plurality of tablets (not shown) is poured onto the tablet loading areas 192 and 193. The tablets are then brushed or swept into the tray cavities, thereby enabling efficient and effective transfer of the tablets from the platforms into the cavities in the tray 21. In this manner, loading of the tray is readily accomplished.

It will be evident that there are additional embodiments and applications that are not disclosed in the detailed description but which clearly fall within the scope of the present invention. The specification is, therefore, intended not to be limiting, and the scope of the invention is to be limited only by the following claims.

What is claimed is:

1. A tablet splitting apparatus, comprising:

a frame having a tray receiving opening;

a tablet receiving tray mounted in said opening for receiving and aligning a plurality of tablets for splitting purposes; and said tablet receiving tray having a continuous channel of interconnected cavities disposed in a path of travel for a single blade to facilitate splitting a plurality of tablets in a single operation.

2. A method of splitting a plurality of tablets in a single operation; comprising:

providing a frame having a tray receiving opening;

placing a tablet receiving tray in said opening; said tablet receiving tray having a continuous channel of interconnected cavities containing the plurality of tablets: and moving a single blade into said continuous channel a sufficient distance to split the plurality of tables in the single operation.

3. A tablet splitting apparatus, comprising:

a base;

means disposed on said base for receiving a plurality of tablets and for holding each one of said plurality of tablets in position to be split;

a movable handle pivotally attached to said base, said handle including a blade for splitting each one of said plurality of tablets as said plurality of tablets is held by said holding means; and a chute for loading tablets in said tablet receiving means.

4. The tablet splitting apparatus according to claim 3, wherein said table receiving and holding means disposed on said base includes a finger grip tab.

5. The tablet splitting apparatus according to claim 3, wherein said base has an elongated configuration, said base including a hinge for attaching said handle to said base and for enabling handle movement between a tablet loading position and a tablet splitting position.

6. The tablet splitting apparatus according to claim 3, including a frame mounted on said base for receiving said table receiving means and for aligning said means with said blade.

7. The tablet splitting apparatus according to claim 3, wherein said handle includes a receptacle for receiving said blade.

8. The tablet splitting apparatus according to claim 5, wherein said handle includes means for shielding said blade when said handle is in a tablet loading position.

9. The tablet splitting apparatus according to claim 8, wherein said shielding means includes a first leg disposed along one side of said blade and a second leg disposed along an opposite side of said blade.

10. The tablet splitting apparatus according to claim 5, wherein said apparatus includes a plurality of springs for urging said blade into the tablet loading position wherein each one of said springs is mounted at one end to said base and at another end to said handle.

11. The tablet splitting apparatus according to claim 3, wherein said tablet receiving means is a disposable tray.

12. The tablet splitting apparatus according to claim 6, wherein said frame includes means for aligning said tablet receiving means with said blade for enabling splitting of tablets received in said tablet holding means into substantially equal parts.

13. The tablet splitting apparatus according to claim 8, wherein said means for aligning said tablet receiving means includes a pair of studs mounted on said frame and a corresponding pair of openings formed in said receiving means for receiving said studs.

14. The tablet splitting apparatus according to claim 3, wherein said tablet receiving means includes a plurality of tablet shaped cavities wherein each one of said plurality of cavities is adapted for receiving a tablet and for holding the received tablet in position for splitting.

15. Tablet splitting apparatus, comprising:

an elongated base;

a tray, disposed on said base, for receiving a plurality of tablets and for holding each one of said plurality of tablets in position to be split;

a frame mounted on said base for receiving said tray and for positioning said tray in relation to said base so that each one of said plurality of tablets can be split into substantially equal parts;

a movable handle pivotally attached to said base, said handle including a blade for splitting each one of said plurality of tablets when said plurality of tablets is held by said tray; and a chute for loading tablets in said tray.

16. The tablet splitting apparatus according to claim 15, wherein said frame includes means for aligning said tray with said blade for enabling splitting of tablets received in said tray into substantially equal parts.

17. The tablet splitting apparatus according to claim 16, wherein said means for aligning said tray includes a pair of studs mounted on said frame and a corresponding pair of openings formed in said tray.

18. The tablet splitting apparatus according to claim 15, wherein said tray includes a plurality of cavities wherein each one of said plurality of cavities is adapted for receiving a tablet and for holding the received tablet in position for splitting.

19. A method of splitting a plurality of tablets in a single operation, comprising the steps of:

providing an apparatus for splitting said plurality of tablets, said apparatus including a base and a blade for splitting tablets, said blade being movable between a tablet loading position and a tablet splitting position;

providing a tray for receiving a plurality of tablets and for holding each one of said plurality of tablets in position to be split;

mounting a frame on said base for receiving said tray and for positioning said tray in relation to said base so that each one of said plurality of tablets can be split into substantially equal parts;

attaching pivotally a handle to said base, said handle including said blade for splitting each one of said plurality of tablets when said plurality of tablets is held by said holding means;

loading tablets in said tray; and moving said blade into said tablet splitting position to split each one of said plurality of tablets into substantially equal halves.

20. The method according to claim 19, including the step of providing a chute for loading tablets in said tray.

21. The method according to claim 19, including the step of aligning said loaded tray with said blade.

* * * * *